United States Patent [19]

Harada et al.

[11] Patent Number: 4,890,397

[45] Date of Patent: Jan. 2, 1990

[54] SHOE FOR SPORTS INVOLVING RUNNING

[75] Inventors: Masasuke Harada, Kurume; Hiroshi Kumagawa, Chikugo; Junji Izumi, Ohmuta, all of Japan

[73] Assignee: Nippon Rubber Co., Ltd., Tokyo, Japan

[21] Appl. No.: 749,831

[22] Filed: Jun. 28, 1985

[30] Foreign Application Priority Data

Jun. 30, 1984 [JP] Japan ..... 59-135818

[51] Int. Cl.[4] ..... A43B 13/12; A43B 13/14

[52] U.S. Cl. ..... 36/30 R; 36/32 R; 36/37; 36/114

[58] Field of Search ..... 36/114, 92, 25 R, 27, 36/28, 30 R, 30 A, 31, 32 R, 37, 38, 25 A

[56] References Cited

U.S. PATENT DOCUMENTS

| | | | |
|---|---|---|---|
| 682,940 | 9/1901 | Keller | 36/35 R |
| 1,319,049 | 10/1919 | Demirjian | 36/35 R |
| 1,346,038 | 7/1920 | McEwan | 36/35 R |
| 1,629,916 | 5/1927 | Hirshfield | 36/35 R |
| 1,666,603 | 4/1928 | Letchford | 36/35 R |
| 2,154,241 | 4/1939 | Herbst | 36/35 R |
| 3,738,373 | 6/1973 | Glancy | 36/35 A X |
| 4,043,058 | 8/1977 | Hollister et al. | 36/28 X |
| 4,128,950 | 12/1978 | Bowerman et al. . | |
| 4,297,796 | 11/1981 | Stirtz et al. | 36/37 X |
| 4,378,642 | 4/1983 | Light et al. . | |
| 4,486,964 | 12/1984 | Rudy | 36/28 |
| 4,506,462 | 3/1985 | Cavanagh | 36/30 R X |
| 4,547,979 | 10/1985 | Harada et al. | 36/31 X |

*Primary Examiner*—Stephen Marcus

*Attorney, Agent, or Firm*—Armstrong, Nikaido, Marmelstein, Kubovcik & Murray

[57] ABSTRACT

A shoe for use in sports involving running and comprising an outer ground engaging sole, an inner foot engaging sole and a midsole therebetween, the midsole having therein, at least at the outer portion of the heel, a shock absorbing member comprising a shock absorbing synthetic resin foam layer bonded at its upper and lower surfaces to hard plates.

8 Claims, 2 Drawing Sheets

SHOE FOR SPORTS INVOLVING RUNNING

This invention relates to shoes for use in sports involving running such as running shoes, basketball shoes, tennis shoes, soccer shoes, and the like.

It has heretofore been generally known, in shoes for use in sports involving running, to make a midsole of an elastic foam member with cushion properties for running. During the gait cycle of a runner, the body-weight load applied to the sole of the foot begins with the initial action of contact of a rearward outside portion of the heel portion with the ground. Ground contact is gradually moved in sequence in conjunction with the subsequent contacting of the outside portion of the planter arch portion of the runner's foot with the ground, then to the ball portion of the fifth toe to the ball portion of the first toe, and the final action of the runner's foot of kicking off from the ground with the first toe portion and the second-fifth toe portions.

At the time of initial ground contacting, a shock force three times the body-weight of the runner is applied to the rearward outside portion of the heel portion of the shoe sole. At that moment, because of the cushion property of the midsole, a rearward outside portion of the heel portion of the midsole is rapidly compressed. Then, by the subsequent rapid elastic restoring force of the midsole, the foot in the shoe, especially, the heel portion of the foot, is given an excess inward turning, that is, an over-pronation. This over-pronation becomes a cause of injury to the ankle or the knee joint of the runner.

To solve the foregoing problem, there has been hitherto proposed an arrangement disclosed in Japanese Unexamined Utility Model Application Publication Sho 58-168203. In such proposed arrangement, a shock absorbing member comprising a hard plate adhered to the lower surface of a foam or non-foam polyurethane elastomer having a 30–70 Shore hardness and 0.5 –40% resilience is inserted as a cushion at the midsole in the heel portion of the shoe sole.

In the arrangement of the Japanese '203 publication, the shock force generated at the time of initial ground contact is absorbed by the shock absorbing member to prevent the foot from over-pronation caused by the cushion midsole. However, because the shock absorbing member thereof is high in compression permanent set, the upper portion of the shock absorbing member remains deformed in the course of wearing the shoe repeatedly for a long time. Thus, the heel portion of the insole, on the upper surface of the shock absorbing member, becomes caved in, and the supporting property is lost. The wearing feeling is damaged and the shock absorbability is lowered.

This invention has for its object to provide a sports shoe free of the foregoing problems, for preventing the heel portion of the shoe sole from caving-in, to thereby improve the heel portion supporting property thereof, to prevent the foot from over-pronation at the time of the initial ground contacting action and to improve the wearing feeling of the shoe.

To achieve this object, the shoe of this invention has a shoe sole comprising an outsole and a midsole having a cushion property, and is characterized in that a shock absorbing member, comprising a shock absorbable synthetic resin foam layer interposed between and adhered to a pair of upper and lower hard plates, is provided between the outsole and the midsole so as to be positioned in a heel portion of the shoe sole.

The invention will be better understood from the following description of preferred embodiments taken with the appended drawings in which.

Figure 1:
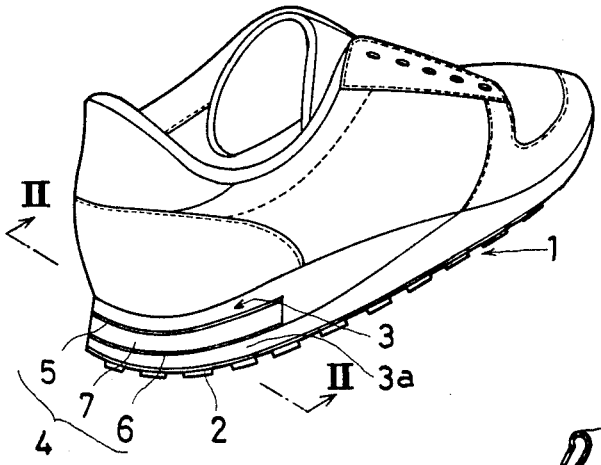
FIG. 1 is a perspective view of one embodiment of the shoe of the instant invention.
Figure 2:
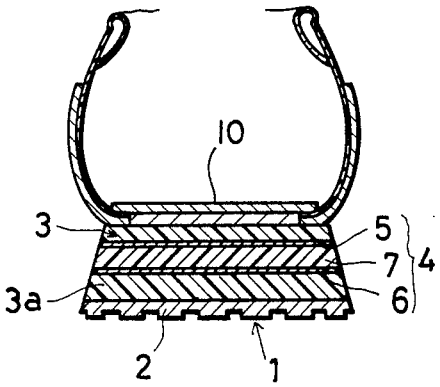
FIG. 2 is a sectional view taken along the line II—II in FIG. 1.
Figure 3:
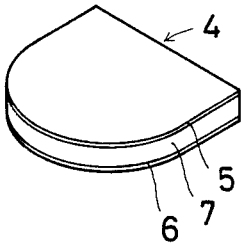
FIG. 3 is a perspective view of a shock absorbing member thereof.

Referring to FIGS. 1–3 showing one embodiment of the invention, shoe sole 1 comprises an outsole 2, a midsole 3 having a cushion property, a shock absorbing member 4 inserted in and adhered to a heel portion of midsole 3 and an inner foot engaging sole 10.

As shown clearly in FIGS. 2 and 3, shock absorbing member 4 comprises a pair of upper and lower plates 5, 6 and shock absorbable synthetic resin foam layer 7 interposed between and adhered to plates 5, 6.

The outsole 2 and cushion midsole 3 are not different from those used in the conventional running shoe.

Each of plates 5, 6 is made of a rigid or semi-rigid synthetic resin material, such as of epoxy resin, acrylonitrile butadiene-styrene copolymer resin, polyester resin, , acrylic resin, polyamide resin, phenol resin, melamine resin, dialkyl phthalate resin, fiber-reinforced resin or the like, or of a metallic such as aluminum, steel and the like.

The Shore hardness of each of plates 5, 6 is 50–90, preferably 60–80. If the hardness is less than 50, the plate is low in rigidity, and the reflecting resonance damping action generated in the shock absorbing member 4, as described hereinafter, is lower. If the hardness is more than 90, the plate is too high in rigidity, so that a bending property for improving a wearing feeling of the shoe sole is lowered. The thickness of each of these plates 5, 6 is 0.05–1 mm, preferably 0.1–0.7 mm. If the thickness is less than 0.05 mm, not only the reflecting resonance damping action is lowered but the adhering thereof to shock absorbable foam layer 7 is difficult. If the thickness is more than 1.0 mm, the shock at the time of the initial ground contacting is not properly transmitted therethrough to the shock absorbable foam layer 7.

The shock absorbable foam layer 7 interposed between the plates 5, 6, has a viscoelasticity so that shock applied thereto is converted into thermal energy and is self-absorbed therein by the low resiliency resulted from the viscoelasticity thereof. The resiliency of the foam layer 7 is lower than that of a fully elastic member having no viscosity.

The viscoelastic material of foam layer 7 is, for instance, an incompletely cross-linked urethane foam or a foam prepared by mixing comparatively large amount of viscous material in rubber or a copolymer resin of ethylene and vinyl acetate and foaming and cross-linked the mixture.

The hardness of foam layer 7, under SRIS-0101 (hardness measured by a compression hardness test in accordance with Japanese Rubber Corporation Standard relating to a physical testing method for expanded rubber), is 40–80, preferably 50 –80. If the hardness is less than 40, the foam layer is soft and is easily compression-deformed by a small shock and shock absorbability thereof is insufficient. If, on the other hand, the hardness is more than 80, the foam layer is too hard and a compression-deformation is too small, and shock absorbability thereof is to low.

The resilience of foam layer 7, measured by a test under JIS K6301, is 2–25%, preferably 5–15%. If the resilience is less than 2%, a deformed state of the foam layer continues for a long time after foam layer 7 is deformed by a shock generated at the time of initial ground contacting. Consequently, the foot is not restored to proper posture after initial ground contacting. If less than 25%, the shock absorbability of foam layer 7 is lowered.

The thickness of foam layer 7 should be 1 mm or more. If the thickness is less than 1 mm, the foam layer 7 does not have sufficient shock absorbability.

The operation of the shoe constructed in accordance with FIGS. 1 and 3 is explained, as follows:

Shock generated at the time of initial ground contact of the outside portion of the heel portion of shoe sole 1 with the ground is transmitted to shock absorbable foam layer 7 through outsole 2, midsole 3 and hard plate 6. Because of the low resilience caused by the viscoelasticity of the foam layer 7, some of the shock is converted into a thermal energy and is self-absorbed. At the same time, the shock undergoes a reflecting resonance between hard plates 5, 6, bonded on the upper and lower surfaces of the foam layer 7, and is self-absorbed by a reflecting resonance damping action caused by the viscoelasticity of the foam layer 7 interposed between and adhered to plates 5, 6. Consequently, the shock absorbability at the outside portion of the heel portion of the shoe sole 1 is extremely improved, and the over-pronation of the foot, otherwise caused at the time of the initial ground contacting, is prevented. By the action of the two hard plates adhered to the foam layer 7, and the cushion property of the midsole 3 at the outside portion of the heel portion of the shoe sole 1 prevents permanent deformation of the shock absorbability of the foam layer 7. Consequently, the supporting property for the heel portion of the foot by the shoe is improved. Additionally, by their cooperative effects, the wearing feeling of the shoe is improved.

Figure 4:
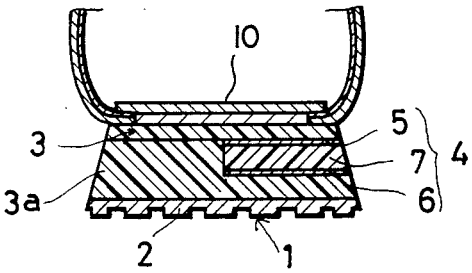
FIG. 4 is a sectional view, similar to FIG. 2, showing another embodiment of the shoe of the invention.

FIG. 4 shows a modification of the embodiment of FIGS. 1–3. The embodiment of FIG. 4 is not especially different in construction from the embodiment of FIGS. 1–3, except that the shock absorbing member 4 is provided only on an outside half of the heel portion of the shoe sole 1.

Thus, the object of this invention for preventing the foot from over-pronation is achieved in the embodiment of FIG. 4 in the same manner as already described in the embodiment of FIGS. 1–3.

In the embodiments of FIGS. 1 and 4, the midsole 3 is formed to have a second midsole 3*a* interposed between the outsole 1 and the shock absorbing member 4, but this second midsole 3*a* is not necessary.

Where midsole 3 is composed of plural layers, if the midsole 3 is arranged so that the hardness is gradually increased from the uppermost layer towards a lowermost layer, the shock from the ground contacting the surface of the shoe sole 1 can be softened. Additionally, because the upper layer is softer than the lower layer, a suitable cushion property is given to the sole of the foot and the wearing feeling is improved.

Figure 5:
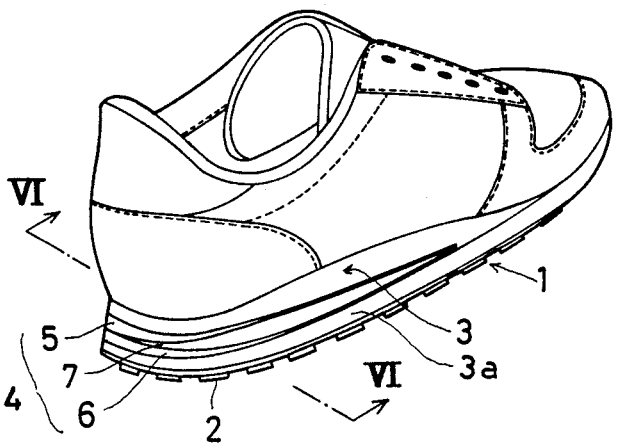
FIG. 5 is a perspective view of still another embodiment of the shoe of the invention.
Figure 6:
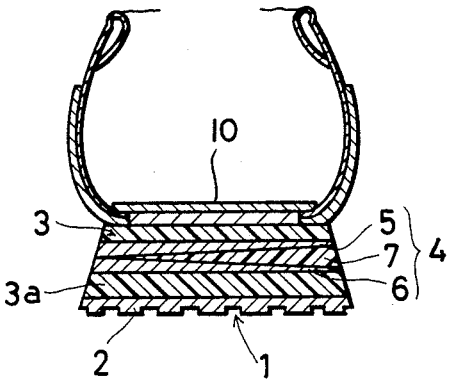
FIG. 6 is a sectional view taken along the line VI—VI in FIG. 5.
Figure 7:
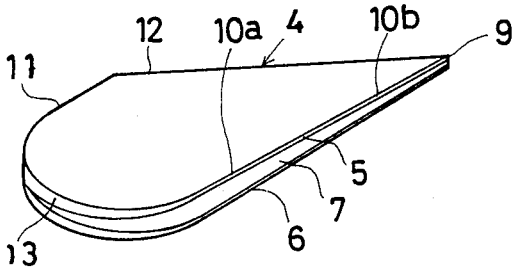
FIG. 7 is a perspective view of a shock absorbing member of FIGS. 5 and 6.

FIGS. 5–7 show an embodiment of the invention, wherein the shock absorbing member 4 is changed in shape and construction. The plate and shock absorbing layer material are the same as those in the foregoing embodiment.

In the embodiment of FIGS. 5–7, the shape of the shock absorbing member 4 is as shown in FIG. 7, and is defined by an extended outside edge 10*b* extending forwards from an outside portion 10*a* corresponding to the heel portion of the shoe sole 1, an extended traversal edge 12 extending between a forward end 9 of the extended outside edge 10*b* and an inside edge 11 corresponding to the heel portion of the shoe sole 1 and a rear side edge 13 connecting between the outside edge 10*a* and the inside edge 11.

By inserting the shock absorbing member 4 of the shape of FIG. 7 in the heel portion of the shoe sole 1, shock can be absorbed more widely at the outside portion of the shoe sole 1, and the over-pronation of the foot can be prevented more effectively.

Additionally, as shown in FIGS. 5–7, the shock absorbable foam layer 7 is gradually increased in thickness according as it extends from an inside of the heel portion of the shoe sole 1 to an outside thereof, while, in contrast therewith, each of the rigid plates 5, 6 is gradually decreased in thickness according as it extends from the inside to the outside.

With this arrangement, the shock absorbability can be gradually increased from the inside of the shoe sole 1 toward the outside thereof and, at the same time the hardness thereof can be gradually increased from the outside to the inside. Accordingly, by the cooperative effects of the difference in shock absorbability and the difference in hardness from the inside of the heel portion to the outside thereof, the over-pronation can be prevented more effectively.

Further, as best shown in FIG. 5, if the midsole 3 is provided with the second midsole 3*a* interposed between the shock absorbing member 4 and the outsole 2, a shock at the time of the ground contacting of the shoe sole 1 is transmitted to the shock absorbing member 4 through midsole 3*a* positioned on a lower surface of the member 4 and is cushioned by the midsole 3*a* and, thereafter, is self-absorbed in the shock absorbing member 4, so that the shock absorbing effect is improved. In addition, the shock is transmitted to the sole of the foot while being softened through the midsole 3 positioned on the upper surface of the shock absorbing member 4 and the wearing feeling is improved.

The terms and expressions which have been employed are used as terms of description and not of limitation, and there is no intention, in the use of such terms and expressions, of excluding any equivalents of the features shown and described or portions thereof, but is recognized that various modifications are possible within the scope of the invention claimed.

What is claimed:

1. A shoe for use in sports involving running, said shoe comprising, an outer ground engaging sole, an inner foot engaging sole and an intermediate cushioning midsole, characterized in that a shock absorbing member comprising a shock absorbable synthetic resin foam layer having a SRIS-0101 compression hardness of not substantially less than 40 and not substantially more than 80 interposed between and adhered to a pair of upper and lower non-shock absorbing plates having a Shore hardness of not substantially less than 50 and not substantially more than 90 is provided between the outer sole and the midsole in a heel portion of said shoe.

2. A shoe for use in sports, as recited in claim 1, in which each of said plates are made from a material selected from rigid and semi-rigid synthetic resins and metals.

3. A shoe for use in sports, as recited in claim 1, wherein each of said plates is made of a synthetic resin plate having a Shore hardness not substantially less than 60 and not substantially more than 80 and is from about 0.05 to about 1.0 mm thick.

4. A shoe for use in sports, as recited in claim 1, wherein the shock absorbable synthetic resin foam layer has a SRIS-0101 compression hardness of not substantially less than 50 and not substantially more than 80, a JIS K6301 resilience of not substantially less than 2.0 to 25% and a thickness not less than 1 mm.

5. A shoe for use in sports, as recited in claim 1, wherein a second cushioning midsole is interposed between the shock absorbing member and the outer sole.

6. A shoe for use in sports, as defined in claim 1, wherein the shock absorbing member is provided in an outer half region of the heel portion of the shoe sole.

7. A shoe for use in sports, as recited in claim 1, wherein at least one of the hard plates gradually decreases in thickness from an inside of the heel portion of the shoe sole to an outside of the heel portion thereof, while the shock absorbable synthetic resin foam layer gradually decreases in thickness from the outside of the heel portion of the shoe to the inside of the heel portion thereof.

8. A shoe for use in sports, as recited in claim 1, wherein the shock absorbing member is defined by an extended forward outside edge extending from an outside edge corresponding to the heel portion of the shoe, a transversal edge extending between a forward end of the extended outside edge an inside edge corresponding to the heel portion of the shoe sole, and a rear side edge extending between the outside edge and the inside edge thereof.

* * * * *